United States Patent [19]

Sakamoto et al.

[11] Patent Number: 4,674,439

[45] Date of Patent: Jun. 23, 1987

[54] DEVELOPING DEVICE

[75] Inventors: Koji Sakamoto; Toshio Kaneko, both of Tokyo; Fuchio Kanno; Wataru Yasuda, both of Yokohama, all of Japan

[73] Assignee: Ricoh Company, Ltd., Tokyo, Japan

[21] Appl. No.: 906,396

[22] Filed: Sep. 12, 1986

Related U.S. Application Data

[62] Division of Ser. No. 466,928, Feb. 16, 1983, Pat. No. 4,625,675.

[30] Foreign Application Priority Data

| | | | |
|---|---|---|---|
| Feb. 17, 1982 | [JP] | Japan | 57-19925 |
| Jun. 3, 1982 | [JP] | Japan | 57-94051 |
| Jun. 4, 1982 | [JP] | Japan | 57-94778 |
| Jun. 16, 1982 | [JP] | Japan | 57-101965 |
| Jun. 24, 1982 | [JP] | Japan | 57-93678 |

[51] Int. Cl.[4] ..... G03G 15/09

[52] U.S. Cl. ..... 118/657; 118/658

[58] Field of Search ..... 118/657, 658

*Primary Examiner*—Bernard D. Pianalto

*Attorney, Agent, or Firm*—Oblon, Fisher, Spivak, McClelland & Maier

[57] ABSTRACT

A developing device for developing an electrostatic latent image formed on an image bearing member such as a photosensitive member for use in an electrophotographic copying machine and the like using magnetic toner particles includes a rotatable sleeve, a magnet roll disposed inside of the sleeve and a doctor blade pressed against the sleeve for charging and forming a thin film of toner particles to be used in developing the latent image. In one form, the blade is provided movably in parallel with the rotating axis of the sleeve. In another form, an electrically conductive brush is provided to remove residual charges from the sleeve after each developing operation. In a further form, the tip end of the blade is disposed between the two adjacent magnetic poles of the magnet roll. In a still further form, the blade is constructed to have a two-part structure.

7 Claims, 33 Drawing Figures

DEVELOPING DEVICE

This is a division of application Ser. No. 466,928, filed Feb. 16, 1983, now U.S. Pat. No. 4,625,675.

BACKGROUND OF THE INVENTION

1. Field of the Invention

This invention relates to a developing device for developing an electrostatic latent image with toner powder, and, in particular, to a developing device for use in an electrophotographic copying machine and the like for developing an electrostatic latent image by a thin film of magnetic toner particles.

2. Description of the Prior Art

A developing device for developing an electrostatic latent image formed on an image carrying member such as a photosensitive member by magnetic toner particles is well known in the art. In particular, in electrophotographic copying machines, it is the recent tend to use magnetic toner particles, which include both magnetic and coloring materials, as a developer instead of a mixture of toner particles and carrier beads. When an electrostatic latent image is to be developed by such magnetic toner particles, it is first necessary to make a thin film of such magnetic toner particles and then such a film is brought into contact with or closer to the latent image to be developed.

FIG. 1 shows such a typical prior art developing device. As shown, the developing device includes a sleeve 1 which is driven to rotate in the direction indicated by the arrow A, a magnet roll 2 having a plurality of poles arranged along it periphery and a blade 3 which is supported in a cantilever fashion by a holder 4 at its top end. The blade 3 is made of a magnetic material and thus it is resiliently pressed against the peripheral surface of the sleeve 1 due to the magnetic attractive forces exerted by the magnet roll 2. The free end, or the bottom end in the illustrated example, of the blade 3 is pointed in the direction counter to the rotating direction of the sleeve 2 at the contact line between the sleeve 2 and the blade 3. It is true that, with such a structure, by supplying magnetic toner particles to the peripheral surface of the sleeve 1 upstream of the contact line between the sleeve 2 and the blade 3, a thin film of uninformly charged toner particles may be obtained on the peripheral surface of the sleeve 1 in the downstream of the contact line, and, thus, such a film of toner particles may be used for developing an electrostatic latent image.

However, it has been found that appreciable streaks are formed in the resulting thin film of toner particles when the device of FIG. 1 has been used for an extended period of time. One of the causes of formation of such streaks is local sticking of toner particles to the free end portion of the blade 3. As mentioned previously, since the free end portion of the blade 3 is lightly pressed against the peripheral surface of the sleeve 1, toner particles may be locally stuck to the free end portion which is in sliding contact with the sleeve 1 under pressure. Such patchy toner particles stuck to the free end of the blade 3 could cause streaks to be formed in the toner thin film. Formation of such streaks is undoubtedly disadvantageous in the developing process.

SUMMARY OF THE INVENTION

The disadvantages of the prior art are overcome and an improved developing device for developing an electrostatic latent image using magnetic toner particles is provided.

A primary object of the present invention is to provide an improved developing device for developing an electrostatic latent image using magnetic toner particles.

Another object of the present invention is to provide a developing device capable of forming a thin film of magnetic toner particles to be applied to an electrostatic latent image without forming streaks.

A further object of the present invention is to provide a developing device capable of developing an electrostatic latent image using magnetic toner particles at an enhanced developing efficiency.

A still further object of the present invention is to provide a magnetic toner powder developing device having a long service life and consistent performance.

A still further object of the present invention is to provide a magnetic toner powder developing device which is free of toner filming problem.

Other objects, advantages and novel features of the present invention will become apparent from the following detailed description of the invention when considered in conjunction with the accompanying drawings.

DESCRIPTION OF THE PREFERRED EMBODIMENTS

Figure 1:
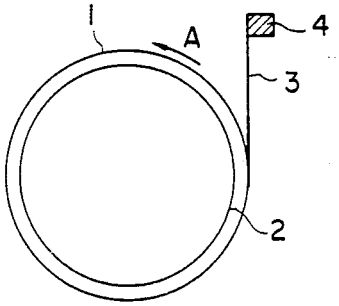
Fig. 1 PRIOR ART
FIG. 1 is a schematic illustration showing a typical prior art developing device for developing an electrostatic latent image with magnetic toner powder.
Figure 2:
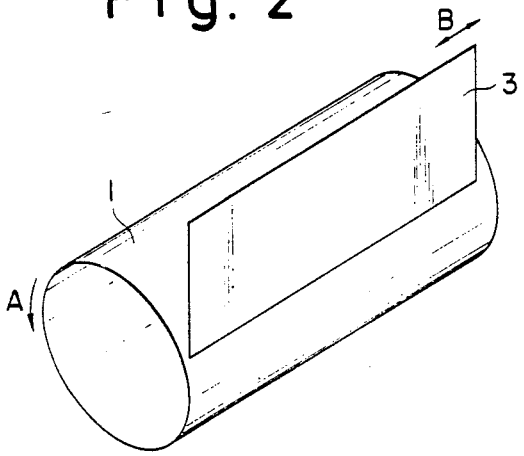
FIG. 2 is a perspective view of the magnetic toner powder developing device useful for explaining the principle of one form of the present invention for preventing the formation of streaks inthe thin film of magnetic toner particles to be used for the developing operation by moving the blade 3 in parallel with the rotating axis of the sleeve 1.

Referring now to FIG. 2, in accordance with the principle of one form of the present invention, the blade 3 is moved in parallel with the rotating axis of the sleeve 1. As indicated by the double-sided arrow B, the movement of the blade 3 may be reciprocal, or, alternatively, it may be one way as will be described later. By moving the blade 3 in this manner, toner particles may be prevented from being stuck to the free end of the blade 3, and thus no appreciable streaks are formed in the thin film of toner particles.

Figure 3:
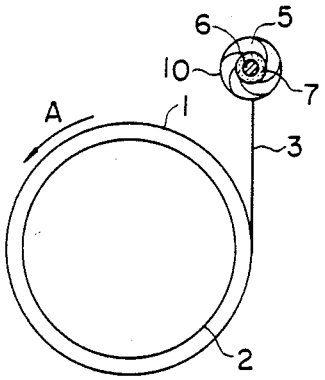
FIG. 3 is a schematic illustration showing one embodiment of the present invention constructed in accordance with the principle shown in FIG. 2.
Figure 4:
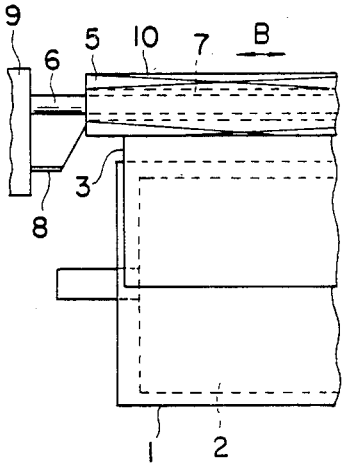
FIG. 4 is a fragmentary front view of the embodiment shown in FIG. 3.

FIGS. 3 and 4 show one embodiment of the developing device constructed in accordance with the above-described principle. As shown, the developing device includes the sleeve 1 which is driven to rotate in the direction indicated by the arrow A, the magnet roll 2 disposed inside of the sleeve 1 and provided with a plurality of magnetic poles arranged around the periphery and the blade 3 having its free end or bottom end pressed against the peripheral surface of the sleeve 1. The developing device also includes a plastic pipe 10 to which the top end of the blade 3 is fixed. A coil 5 is provided inside of the plastic pipe 10. A magnet rod 6 extends through the pipe 10 and thus the coil 5 and its both ends are fixed to holders 9 (only one holder 9 is shown). A lubricating layer 7 is provided in the gap between the magnet rod 6 and the coil 5 so that the coil 5 and thus the pipe 10 may move along the rod 6. A support spring 8 is provided to limit the movement of the pipe 10.

With this structure, when an a.c. current is supplied to the coil 5, the coil 5 together with the pipe 10 is set in vibration in the direction indicated by B, so that the blade 3 is also set in vibration in the same manner. As a result, the blade 3 moves back and forth in parallel with the rotating axis of the sleeve 1 with maintaining the pressure contact with the sleeve 1. When the blade 3 was made of a leaf spring of 50 to 100 microns thick and the 300 Hz a.c. current was applied to the coil 5 to set the blade 3 in vibration with amplitude of approximately 0.5 mm, no toner particles were found to be stuck to the blade 3.

Figure 5:
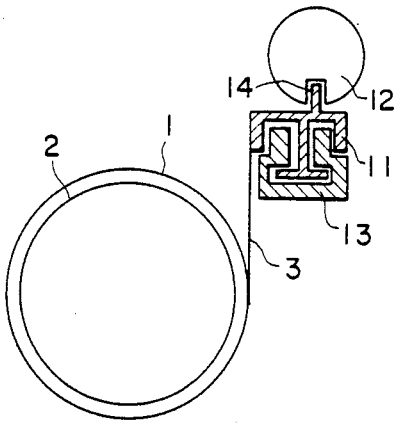
FIG. 5 is a schematic illustration showing another embodiment of the present invention constructed in accordance with the principle shown in FIG. 2.
Figure 6:
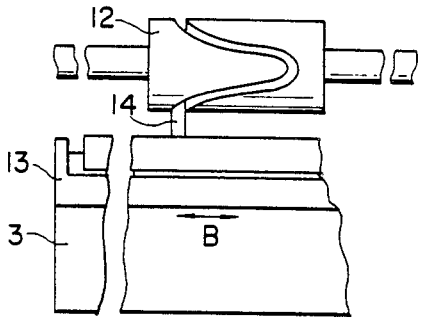
FIG. 6 is a fragmentary front view of the embodiment shown in FIG. 5.

FIGS. 5 and 6 show another embodiment of the present developing device, in which the top end of the blade 3 is fixedly attached to a slider member 11 which is slidably supported by a rail 13 positioned in parallel with the rotating axis of the sleeve 1. Also provided is a grooved cam 12 which is provided with an endless groove in the shape of a sinusoidal curve and disposed above the slider member 11 such that a pin 14 projecting from the slider member 11 engages in the groove of the cam 12. With this structure, when the grooved cam 12 is driven to rotate, the slider member 11 executes a reciprocating motion in the direction B, and, thus, the blade 3 moves back and forth in parallel with the rotating axis of the sleeve 1 while maintaining the pressure contact between the free end of the blade 3 and the sleeve 1. As compared with the previous embodiment, the present embodiment is lower in frequency but is easier in obtaining a larger amplitude. It has been found that the present embodiment is equally effective in preventing sticking of toner particles from taking place.

Figure 7:
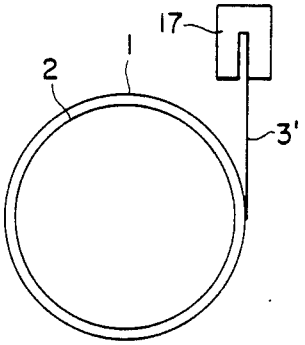
FIG. 7 is a schematic illustration showing a further embodiment of the present invention constructed in accordance with the principle shown in FIG. 2.
Figure 8:
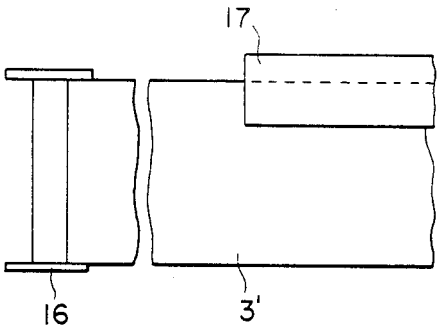
FIG. 8 is a fragmentary front view of the embodiment shown in FIG. 7.
Figure 9:
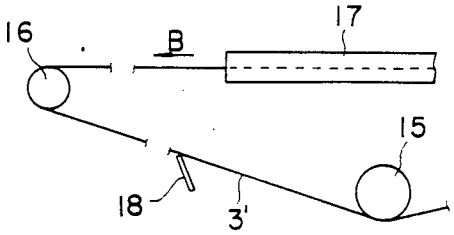
FIG. 9 is a fragmentary plan view of the embodiment shown in FIG. 7.

FIGS. 7–9 illustrate a further embodiment of the present developing device. As shown, in this embodiment, instead of the plate-shaped blade 3 in either of the above embodiments, use is made of an endless belt 3' having magnetic and elastic properties and extended between pulleys 15 and 16. The pulley 16 is provided with a pair of flanges on top and bottom between which the belt 3' is passed around and such a pulley 16 is disposed one on each end of the sleeve 1, though only one of them is shown in the drawings. Therefore, the bottom portion of the belt 3' between the pulleys 16, 16 is preseed against the sleeve 1. Furthermore, a guide 17 is provided to guide the advancement of the belt 3' between the end pulleys 16, 16, so that the travelling path of the belt 3' is well defined by the flanged pulleys 16, 16 and the guide 17 thereby allowing the belt 3' to carry out the desired function which is expected for the blade 3 in either of the above-described embodiments. In this embodiment, the belt 3' may be advanced only in a predetermined direction, and such a one-way movement is preferable because the belt 3' may be cleaned positively by providing a cleaner 18 in pressure contact with the belt 3'.

Figure 10:
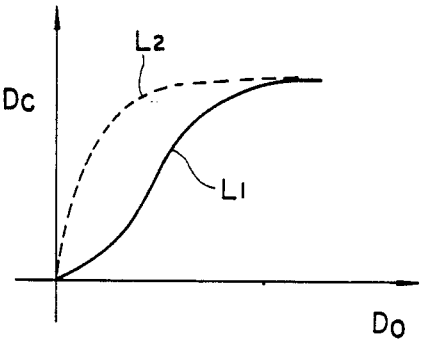
FIG. 10 is a graph showing the desired developing characteristics for area images such as pictures indicated by the dotted line and for line images such as characters indicated by the solid line with the abscissa taken for the image density of an original image and the ordinate taken for the image density of a reproduced image.

In developing an electrostatic latent image with oppositely charged toner powder, different developing characteristics are required depending upon whether the image to be developed is a line image such as a character or an area image such as a picture. FIG. 10 is a graph showing the desired developing characteristics for the line and area images. In the graph, the abscissa is taken for the image density of an original image or an image to be developed and the ordinate is taken for the image density of a copy or developed image. As shown, for the area image denoted by $L_1$, the approximately 45° characteristic is desired, which indicates one to one correspondence in image density between original and developed images. On the other hand, for the line image denoted by $L_2$, the steeper sloped characteristic is desired, which indicates a lower density or hazy image may be developed into a higher density or darker image. The so-called edge effect phenomenon has been utilized to obtain such an increased image density for line images. Customarily, such an edge effect has been sufficiently obtained for the developer comprising toner and carriers. However, in the case of a magnetic toner developer without carriers, a sufficient edge effect cannot usually be obtained.

Figure 11:
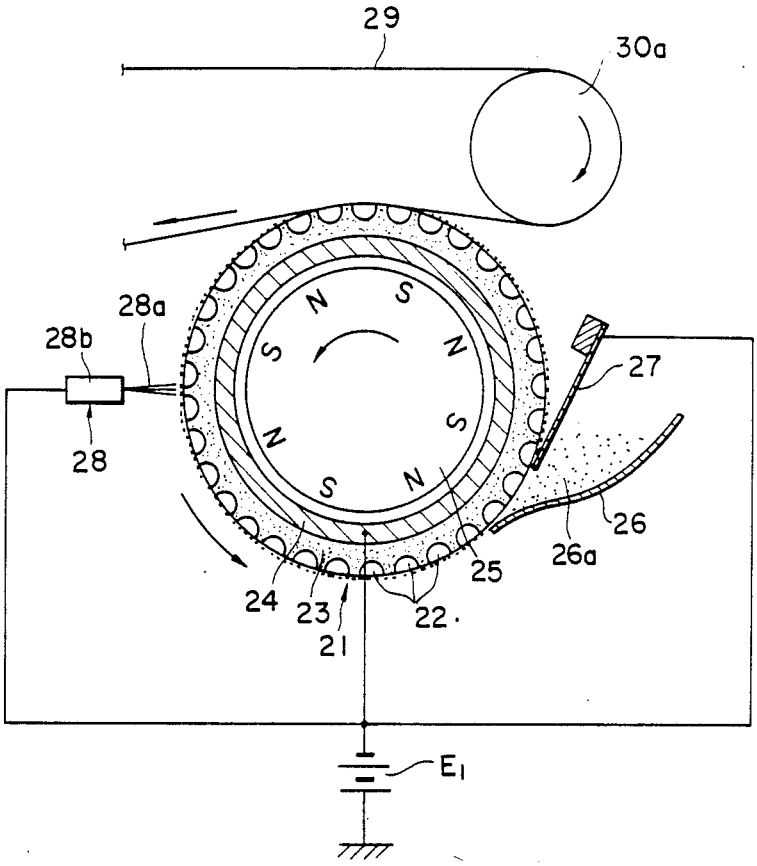
FIG. 11 is a schematic illustration showing a still further embodiment of the present developing device which includes the conductive brush 28.

With the foregoing in mind, FIG. 11 shows one embodiment of the present developing device capable of exhibiting the desired developing characteristics as shown in FIG. 10. As shown, a photosensitive member 29 in the form of an endless belt comprises an electrically conductive support 32 and a photoconductive layer 31 formed on the support 32, and it is extended around a roller 30*a* to be driven to advance in the direction indicated by the arrows at constant speed. The present developing device is disposed below the photosensitive belt 29, and it includes a composite sleeve or toner carrying member 21 which is driven to rotate in the direction indicated by the arrow in rolling contact with the outer surface of the photosensitive belt 29. The composite sleeve 21 includes an inner sleeve 24 of an electrically conductive material, an outer sleeve 23 formed on the inner sleeve from an electrically insulating material and a number of fine floating electrodes 22 of an electrically conductive material partly embedded in and dispersed across the outer surface of the outer sleeve 23. These floating electrodes 22 are electrically isolated from one another. Also provided is a magnet roll 25 as disposed inside of and coaxially with the composite sleeve 21, and, in the illustrated example, the magnet roll 25 is driven to rotate in the direction indicated by the arrow, though the magnet roll 25 may be driven to rotate in the opposite direction or held stationary. A negative bias voltage is applied to the conductive inner sleeve 24 from a voltage source $E_1$.

To the right of the composite sleeve 21 in FIG. 11 is disposed a tank 26 for reserving therein a quantity of magnetic toner particles 26*a*, and thus the toner particles 26*a* are supplied to the peripheral surface of the composite sleeve 21 from the tank 26. In the downstream of the tank 26 with respect to the rotating direction of the composite sleeve 21 is disposed a doctor blade 27 having its top end supported to a housing (not shown) and its bottom or free end pressed against the peripheral surface of the composite sleeve 21. In the further downstream, the composite sleeve 21 is in rolling contact with the photosensitive belt 29 where defines the developing section. Accordingly, an electrostatic latent image formed on the photosensitive belt 29 by any well known image forming process is developed at this developing section. Moreover, in the still further downstream is disposed an electrically conductive brush 28 comprised of fibers 28*a* of an electrically conductive material and a base member 28*b* of an electrically conductive material in which the fibers 28*a* are planted. The brush 28 is so disposed to have the tip ends of the fibers 28*a* lightly contacted the peripheral surface of the composite sleeve 21. And, the brush 28 and the doctor blade 27 are connected to the negative terminal of the voltage source $E_1$ and thus they are maintained substantially at the same potential as the conductive inner sleeve 24.

Figure 12:
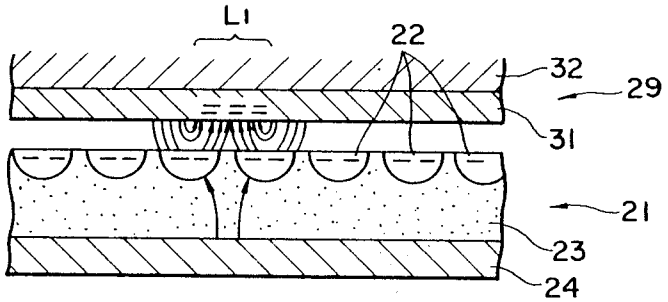
FIGS. 12 and 13 are fragmentary, cross sectional views of the composite sleeve 21 and the photosensitive member 29 at the developing section of the device shown in FIG. 11, which are useful for explaining the differences in developing area and line latent images.
Figure 13:
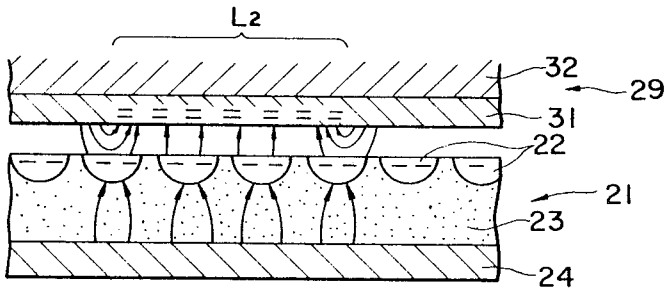

In operation, the magnetic toner particles 26*a* as supplied to the peripheral surface of the composite sleeve 21 from the tank 26 are attracted to the surface due to magnetic forces applied by the magnetic roll 25. As the composite sleeve 21 rotates, the thus attracted toner particles are formed into a thin film of desired thickness and at the same time charged to a desired polarity, positive polarity in the present example, by the doctor blade 27. Thereafter, the thus formed thin film of charged toner particles is applied to the belt 29 at the developing section. In the developing section, where the composite sleeve 21 carrying thereon a thin film of charged toner particles is opposed to, in contact with or with a gap therebetween, the photosensitive belt 29, there is formed an electric field, as also shown in FIGS. 12 and 13. FIG. 12 is the case when the original image is a line image; whereas, FIG. 13 is the case when the original image is an area image. In either case, on the surface of the photosensitive layer 31 is formed an electrostatic latent image by negative charges. For the purpose of clarity, toner particles are omitted in FIGS. 12 and 13.

Since the floating electrodes 22 which have been set to the same potential as that of the inner sleeve 24 by the conductive brush 28 exist around the latent image $L_1$ representing a line image, a part of the electrical force lines emanating from the background portion on the surface of the photoconductive layer 31 directly go into the latent image $L_1$ and another part of the force lines also go into the latent image $L_1$ via some of the floating electrodes 22. That is, the floating electrodes 22 effectively act as the carriers in a toner-carrier mixture developer, and, therefore, the number of force lines directed to the latent image $L_1$ from the background portion is significantly increased thereby allowing to obtain pronounced edge effects. Stated another way, provision of floating electrodes 22 causes to strengthen the electric field in the neighborhood of the latent image $L_1$ so that a large amount of toner particles may be adhered to the latent image $L_1$ thereby allowing to obtain a reproduced image of increased image density.

On the other hand, in the case of a latent image $L_2$ representing an area image, as shown in FIG. 13, the central portion of the latent image receives the force lines emanating from the oppositely positioned floating electrodes 22, and the force lines coming out of the background portion on the surface of the photoconductive layer 31 hardly reach the central portion of the latent image. Accordingly, the electric field in the neighborhood of the latent image $L_2$ is not so much different whether or not the floating electrodes 22 are present, so that the overall amount of deposited toner particles are not significantly influenced by the edge effects. For this reason, the latent image $L_2$ attracts the amount of toner particles in proportion to the intensity of the latent image itself. In this manner, provision of a number of fine floating electrodes 22 in the surface of the composite sleeve 21 allows to obtain the desired developing characteristics as shown in FIG. 10.

Figure 14:
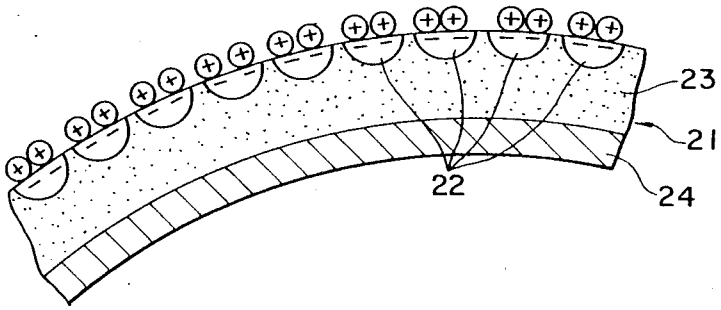
FIGS. 14 and 15 are fragmentary, cross sectional views of the composite sleeve 21 of the developing device shown in FIG. 11.
Figure 15:
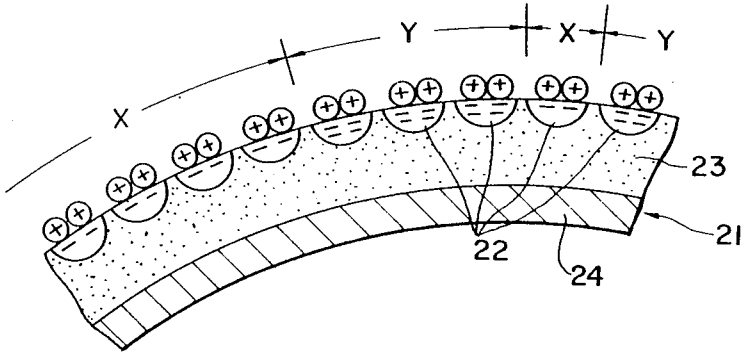

However, as shown in FIG. 14, positively charged toner particles are deposited on the peripheral surface of the composite sleeve 21, and the floating electrodes 22 are charged to the same level as but opposite in polarity to the charges of the toner particles mainly due to frictional charging between the toner particles and the composite sleeve 21. For the purpose of clarity, the deposited toner particles are shown in a single layer in the drawings. The thus formed thin film of toner particles is transported to the developing section as the composite sleeve 21 rotates, and the toner particles are selectively transferred to the photosensitive belt 29 in accordance with the image formed thereon. As a result, as shown in FIG. 15, fresh toner particles will be supplied to those portions Y from where the toner particles have been transferred to the belt 29. In this instance, however, if fresh toner particles are to be directly supplied to those portions Y, since those portions Y of the surface of the dielectric layer 2, in particular the floating electrodes in those portions, retain the negative charges given by the transferred toner particles, the floating electrodes 22 in the portions Y come to bear an increased amount of negative charges as compared with the floating electrodes 22 in those portions X where the toner particles have not been used or transferred in the previous developing operation. As described above, the portions Y store an excessive amount of charges as compared with the portions X so that a ghost image will be formed in the following developing operations.

In order to obviate the above-described problem, provision is made of the conductive brush 28 maintained at a predetermined potential in accordance with one embodiment of the present invention, as shown in FIG. 11. As briefly described previously, the conductive brush 28 is so disposed to have the tip ends of the conductive fibers 28*a* lightly contacted the peripheral surface of the composite sleeve 21 in the downstream of the developing section, and the brush 28 is maintained at a desired bias potential substantially same in level and polarity as that of the conductive inner sleeve 24. With this structure, the excessive charges of the floating electrodes 22 may be discharged through the brush 28 and thus the floating electrodes 22 may be set at the desired potential level after each developing operation. It is to be noted, however, that the brush 28 may be so disposed with a predetermined gap between the tip ends of the fibers 28*a* and the peripheral surface of the sleeve 21. Moreover, other well known discharging means such as an a.c. corona discharging device may be used instead of the brush 28, if desired. However, the brush is preferred because it is simple in structure and low in cost.

Figure 16:
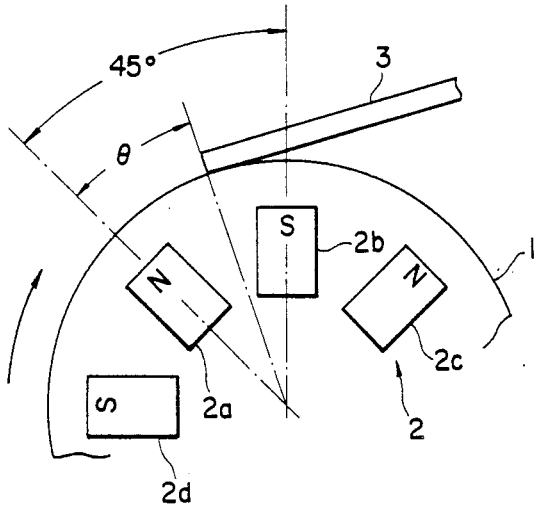
FIG. 16 is a schematic illustration showing the principle of another form of the present invention in which the free end of the blade 3 is disposed midway between the two adjacent magnetic poles.

FIG. 16 is a schematic illustration showing the principle of another embodiment of the magnetic toner powder developing device constructed in accordance with the present invention. FIG. 16 shows the positional relation between the tip end of the doctor blade 3 of a magnetic material and the magnetic roll 2 having a plurality of magnetic poles 2*a*, 2*b*, . . . , etc. disposed inside of the sleeve 1. The sleeve 1 is, for example, comprised of an electrically conductive inner sleeve and a dielectric outer sleeve formed on the outer surface of the inner sleeve whereby the outer peripheral surface of the outer sleeve defines the surface for carrying thereon a thin film of toner particles. In the illustrated example, eight magnetic poles 2*a*, 2*b*, . . . , etc. are arranged along the periphery of the roll 2 equally spaced apart from each other. And thus the magnetic toner particles are first attracted to the peripheral surface of the sleeve 1 and formed into a thin film of uniformly charged particles after passing through the gap between the tip end of the doctor blade 3 and the peripheral surface of the sleeve 1.

Figure 17:
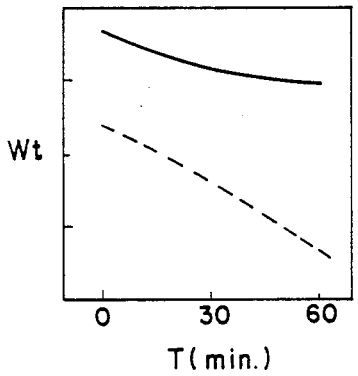
FIG. 17 is a graph showing the toner powder transport characteristics of the sleeve 1 with the abscissa taken for time T in minutes and the ordinate taken for toner transport amount $W_t$ in which the solid line indicates the case of the stationary magnet roll and the dotted line indicates the case of the rotating magnet roll in the same direction as the sleeve 1.

The toner particle transport characteristics measured with the arrangement shown in FIG. 16 are shown graphically in FIG. 17, in which the abscissa is taken for the running time T in minutes and the ordinate is taken for the amount of toner particles transported. In the graph of FIG. 17, the solid line curve indicates the case when the magnet roll 2 has been held stationary as shown and the dotted line curve indicates the case when the magnet roll 2 has been set in rotation in the same direction as the sleeve 1. As shown, the larger amount of toner particles may be transported when the magnetic roll 2 is held stationary as shown and the transport performance does not decay significantly.

Figure 18:
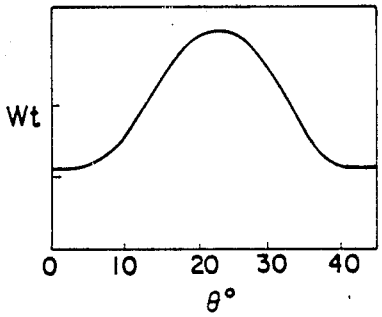
FIG. 18 is a graph showing the relation between the location of the free end of the blade 3, or the angle $\theta$ formed between the free end of the blade 3 and one magnetic pole, and the toner transport amount $W_t$ when measured with the arrangement shown in FIG. 16.

On the other hand, as shown in FIG. 16, the angle formed between the two adjacent magnetic poles, e.g., 2*a* and 2*b*, is 45° since the magnetic poles are arranged equally spaced from one another. In the arrangement of FIG. 16, the angle formed between the tip end of the doctor blade 3 and one of the magnetic poles, i.e., magnetic pole 2*a* in the present case, is denoted by $\theta$. Varying the value of $\theta$, i.e., the positional relation between the tip end of the blade 3 and the magnet roll 2, in particular the magnetic pole 2*a*, the amount of toner particles transported was measured and the results are plotted in the graph of FIG. 18. As clearly shown in the graph of FIG. 18, there is a strong correlation between the amount of toner particles transported and the angle $\theta$. That is, when the tip end of the blade 3 is located closest to either of the magnetic pole 2*a* ($\theta=0°$) and magnetic pole 2*b* ($\theta=45°$), the amount of toner particles transported becomes minimum, which indicates increased sticking of toner particles to the surface of the sleeve 1. On the other hand, when the tip end of the blade 3 is located between the two magnetic poles 2*a* and 2*b*, where $\theta$ is set larger than 0° and smaller than 45°, a larger amount of toner particles may be transported. This is because, in the case when the tip end of the blade 3 is located closest to the magnetic pole, the tip end portion of the blade 3 comes to be strongly attracted to the sleeve 1; whereas, when the tip end of the blade 3 is located between the two magnetic poles 2*a* and 2*b*, the attractive force acting on the tip end portion of the blade 3 toward the sleeve 1 is relatively weaker.

Figure 19:
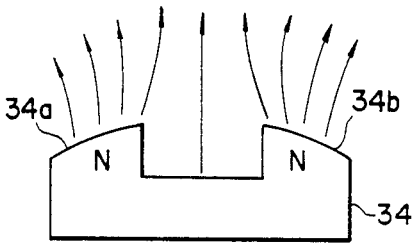
FIG. 19 is a schematic illustration showing the magnetic field distribution of the U-shaped magnet 34.
Figure 20:
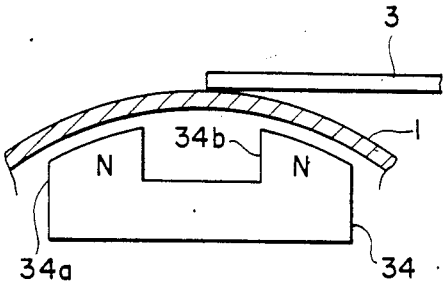
FIG. 20 is a schematic illustration showing the arrangement of the free end of the blade 3 with respect to the U-shaped magnet 34 constructed in accordance with the present invention.

Under circumstances, in order to transport a relatively large amount of toner particles without causing sticking of toner particles to the sleeve 1 and/or the blade 3, it is preferable to provide the magnetic roll 2, or, for that matter, the magnetic poles, fixedly and to dispose the blade 3 such that the tip end of the blade 3 is located midway or inbetween the two adjacent magnetic poles, e.g., 2*a* and 2*b*, most preferably at the center between the two poles. It is to be noted in this case that the two magnetic poles may be opposite in polarity as shown in FIG. 16 or they may be same in polarity. For example, as shown in FIG. 19, a U-shaped magnet 34 having a pair of projected magnetic pole sections 34*a* and 34*b* which are both same in polarity may also be used in the present invention. In such a U-shaped magnet 34, the space between the spaced apart magnetic pole sections 34*a* and 34*b* has a weaker magnetic field. FIG. 20 shows the preferred arrangement when use is made of the U-shaped magnet 34, and, as shown, the magnet 34 is fixedly mounted insided of the sleeve 1 and the blade 3 is so disposed with its tip end located at the center between the two magnetic pole sections 34*a* and 34*b*. With this arrangement, the tip end of the blade 3 is pressed against the peripheral surface of the sleeve 1 at an appropriate pressure.

Figure 21:
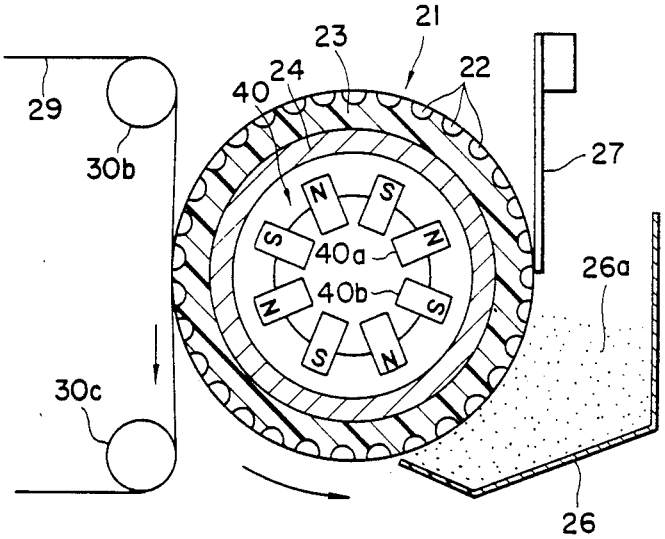
FIGS. 21–23 are schematic illustrations showing several embodiments of the developing device having the free end of the blade located midway between the two adjacent magnetic poles in accordance with the present invention.

FIG. 21 shows the structure of one embodiment of the magnetic toner powder developing device to which the above-described principle of positional relation between the tip end of the blade and the magnetic poles is applied. As shown, the photosensitive belt 29 passed around rollers 30*b* and 30*c* is driven to advance in the direction indicated by the arrow. The belt 29 may have the structure described previously and an electrostatic latent image to be developed by the present developing device is formed on the outer surface by means of any of the well known image forming methods. It should also be noted that, as practiced throughout the present specification, identical numerals are used to indicate identical elements and repetition of description of identical elements will be omitted.

As shown in FIG. 21, the toner particle carrying member or composite sleeve 21 includes the conductive inner sleeve 24 and the dielectric outer sleeve 23 which is preferably made from a dielectric material such as epoxy and polyester resins to the thickness of approximately 500 microns. The finely divided floating electrodes 22 are provided as partly embedded across the entire peripheral surface of the dielectric outer sleeve 23. These floating electrodes 22 are preferably formed from metal, for example copper, particles having the average diameter of approximately 75 microns. In manufacture, copper particles are first provided as embedded in the dielectric layer, the surface of which is then ground to have the embedded copper particles exposed at the ground surface to define the floating electrodes 22 having the semispherical shape, as shown in FIG. 21. Moreover, the peripheral surface of the composite sleeve 21 is so processed to have the surface roughness of approximately 12 microns. The composite sleeve 21 is driven to rotate in the direction indicated by the arrow at constant speed ranging from 180 to 240 r.p.m. in rolling contact with the photosensitive belt 29. Inside of the composite sleeve 21 is fixedly disposed a magnet roll 40 including eight magnetic poles arranged along the inner periphery of the composite sleeve 21 and equally spaced from one another in the circumferential direction with alternating the polarities.

The tank 26 contains a quantity of magnetic toner particles 26*a* including carbon and magnetic powder and having the average diameter of approximately 9 microns and the absolute specific gravity of approximately 1.86. The blade 27 is made of a magnetic material and it may be made of a SK material to the thickness of approximately 0.1 mm or by austenic or martensitic stainless steel to the thickness of approximately 0.07 mm. The blade 27 should have enough flexibility or deflectability and have the width long enough to traverse the end to end length of the composite sleeve 21. The doctor blade 27 is disposed with its free or bottom end in pressure contact with and pointed in the direction opposite to the moving direction of the composite sleeve 21 at the contact line with the sleeve 21. In accordance with the present invention, the blade 27 is so disposed to have the free end located midway between the two adjacent magnetic poles 40*a* and 40*b*, preferably at the center between the two. With this arrangement, the toner particles 26*a* are attracted to the sleeve 21 and formed into a thin film of approximately single layer of uniformly charged toner particles after passing through the contact line between the blade 27 and the sleeve 21. As an example, when the toner particles of the above-described properties were used with the device of FIG. 21, the thin film of toner particles of approximately 0.5 mg/cm$^2$ and 5.0 micro Coulomb/grm was obtained.

Figure 22:
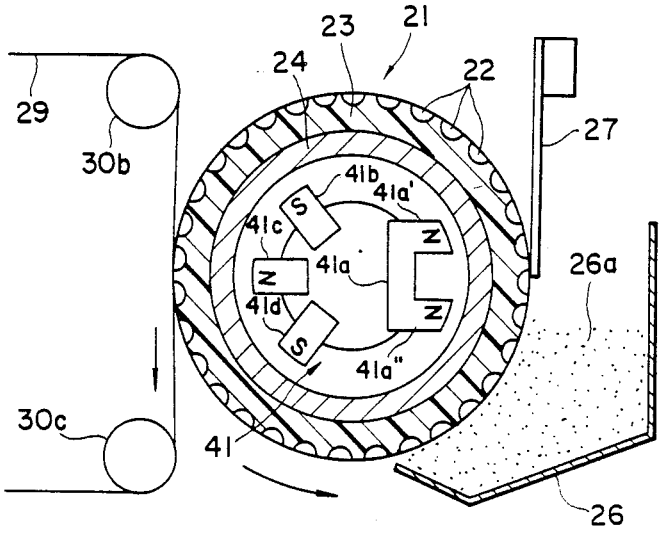

FIG. 22 shows a modification of the developing device of FIG. 21. The developing device of FIG. 22 has a different magnet structure 41 disposed inside of the composite sleeve 21, and the magnet structure 41 includes one U-shaped magnet 41*a* and three straight magnets 41*b*–41*c*. The U-shaped magnet 41*a* has a pair of projecting magnetic pole sections 41*a*′ and 41*a*″ of the same polarity, N in the illustrated example, which are spaced apart from each other. In accordance with the principle of the present invention as described previously, the tip end of the blade 27 is located midway between the pair of magnetic pole sections 41*a*′ and 41*a*″ of the U-shaped magnet 41*a*. In this embodiment also, since the pressure condition between the free end of the blade 27 and the sleeve 21 may be set an appropriate level, the formation of toner filming on the peripheral surface of the sleeve 21 may be effectively avoided. Furthermore, when the pair of magnetic pole sections 41*a*′ and 41*a*″ are of the same polarity as in the embodiment shown in FIG. 22, the toner particles are set in a circulating motion in the neighborhood of the free end of the blade 27 because of the particular magnetic field distribution as shown in FIG. 19, and, as a result, foreign matter such as iron powder mingled in the toner particles may be easily removed and uniformity in the resulting toner thin film is enhanced.

Figure 23:
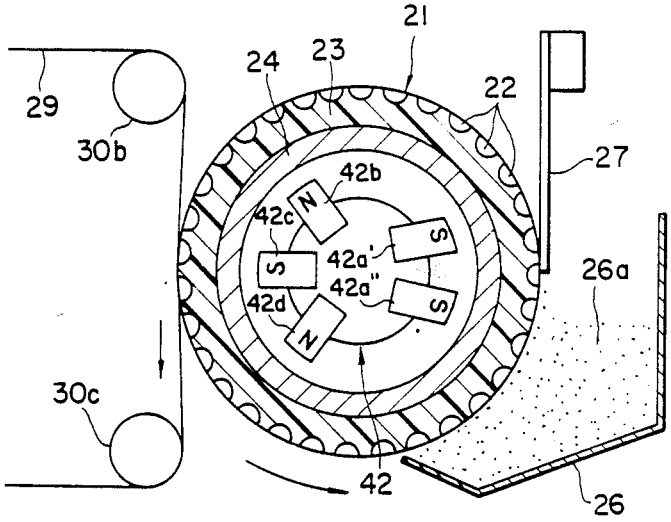

FIG. 23 shows a further modification having a magnetic structure 42 which includes a pair of straight magnets 42*a*′ and 42*a*″ instead of the U-shaped magnet 41*a* of the magnetic structure 41 in FIG. 22. As will be easily understood, the present structure has a higher degree of freedom in adjusting the pressure condition between the blade 27 and the sleeve 21.

In each of the embodiments shown in FIGS. 21 through 23, the blade 27 is so disposed that its free end is in the presence and sliding contact with the peripheral surface of the sleeve 21. In the case where the peripheral surface of the sleeve 21 is so processed to have the roughness in the order of the diameter of the toner particles and the deflectable magnetic blade 27 is disposed with its free end pointed in the direction opposite to the rotating direction of the sleeve 21 as in each of the embodiments shown in FIGS. 21 through 23, a desired thin film of toner particles may be stably formed for a relatively wide range of mounting or supporting point of the blade 27.

Figure 24:
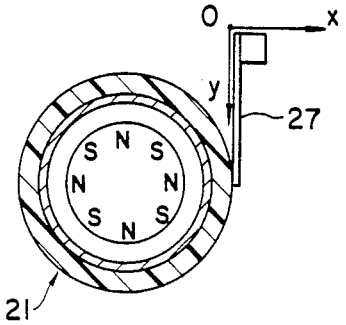
FIG. 24 is a schematic illustration showing the positional relation between the sleeve 21 and the blade 27.
Figure 25:
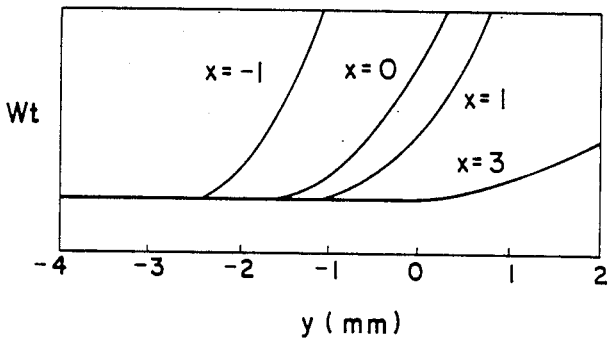
FIG. 25 is a graph showing the relation between the toner transport amount $W_t$ and the vertical position v of the support point of the blade 27 with the horizontal position x of the support point of the blade 27 as the parameter.

As shown in FIG. 24, defining the initial supporting point of the blade 27 as the original point of the x-y coordinate with v axis extending in the tangential direction at the contact line between the sleeve 21 and the blade 27, the amount of toner particles transported was measured by changing the supporting point in x and v axes, and the results are graphically shown in FIG. 25. As is apparent from the graph, toner particles may be transported stably in amount in the range between 0 and 3 mm in the x direction and between −4 and −2 mm in the v direction. This thus indicates that the amount of toner particles to be transported may be maintained at a desired level at all times by providing the blade 27 slightly shiftable in position rather than providing the blade 27 fixed in space.

Figure 26:
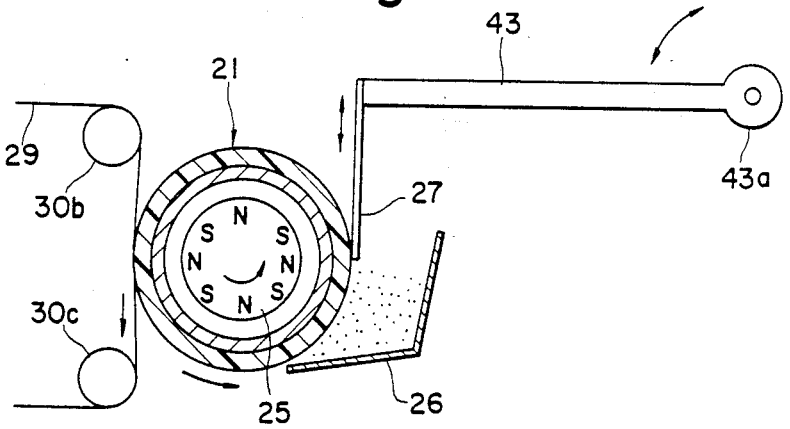
FIG. 26 is a schematic illustration showing another embodiment of the present developing device which has a pivoted support arm 43 for supporting the blade 27.

FIG. 26 shows one embodiment of the magnetic toner developing device having such a shiftable doctor blade. As shown, in this embodiment, the top end of the blade 27 is fixedly attached to the free end of a support arm 43 having its base end 43*a* pivoted to a housing (not shown). With this structure, the arm 43 may pivot slightly as indicated by the double-side arrow so that the blade 27 may move up and down in the range between −4 and −2 mm as set forth above thereby allowing to form a desired thin film of toner particles consistently. It is to be noted that in the embodiment shown in FIG. 26, the magnet roll 25 disposed inside of the sleeve 21 may be set in rotation, if desired. The toner particles have been found to be transported stably by adjusting the tip end of the blade 27 in the range between −4 and −2 mm as described above with the sleeve 21 rotating at 240 r.p.m. and the magnet roll rotating at 1,800 r.p.m.

Figure 27:
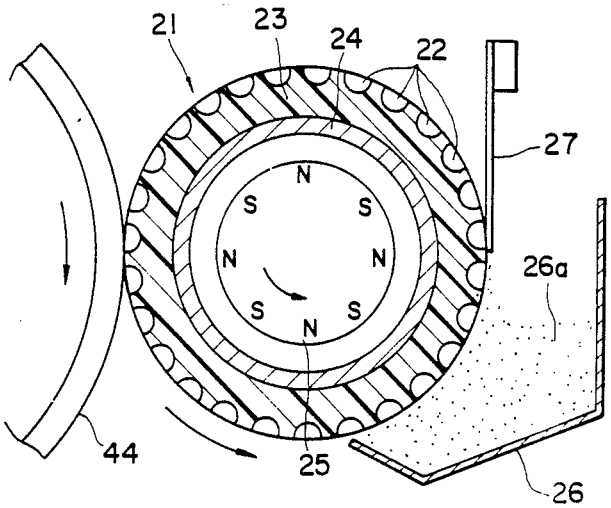
FIG. 27 is a schematic illustration showing still another embodiment of the present developing device.

FIG. 27 illustrates a still further embodiment of the present developing device using magnetic toner particles for developing an electrostatic latent image. In the present embodiment, there is provided a photosensitive drum 44 having a photosensitive member formed on the periphery of a drum. The photosensitive drum 44 is driven to rotate at constant speed in the direction indicated by the arrow, and as the drum 44 rotates, an electrostatic latent image is formed on the peripheral surface by any image forming technology known to those skilled in the art. The surface of the drum 44 bearing thereon the thus formed latent image is brought into contact with or closer to the peripheral surface of the composite sleeve 21 on which a thin film of uniformly charged toner particles is formed, and the latent image is developed into a visual image. In the present embodiment, the sleeve 21 may be driven to rotate, for example, at 180 r.p.m. and the magnet roll 25 at 1,800 r.p.m. Further, the magnetic flux density at the peripheral surface of the sleeve 21 is preferably set in the range between 500 and 1,200 Gauss, most preferably at approximately 900 Gauss. The remaining elements of the device may be constructed in a manner similar to any of the above-described embodiments.

The embodiment of FIG. 27 is characterized by forming the blade 27 to satisfy the following condition.

$$2{,}500 \leqq Ed^3/l^3 \leqq 250{,}000 \qquad (1)$$

where

E: Young's modulus ($N\text{-}m^{-2}$ in unit)

d: thickness (m in unit)

l: length of blade from supporting point to tip end (m in unit).

Figure 28:
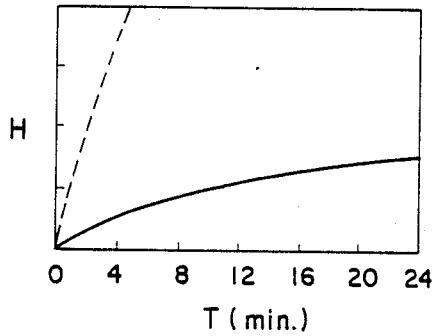
FIG. 28 is a graph showing the growth characteristics of a toner filming with the abscissa taken for time T in minutes and the ordinate taken for the toner filming amount in which the solid curve is for the blade of 0.05 mm thick and the dotted line curve is for the blade of 0.9 mm thick.

When so structured to satisfy the above equation (1), the blade 27, together with the sleeve 21, is prevented from being stuck by the toner particles, and, at the same time, a thin film of toner particles may be formed on the sleeve 21 consistently for an extended period of time. The above condition has been derived by the present inventors as a result of study of various factors which are influential in causing sticking of toner particles to the blade 27 as well as to the sleeve 21. That is, it has been found by the present inventors that the dynamic property of the blade 27 is significantly influential in toner sticking phenomenon. As an example, the relation between the blade thickness and the amount of toner filming on the sleeve 21 using the magnetic flux density of 900 Gauss is graphically shown in FIG. 28. The graph of FIG. 28 has its abscissa taken for running time T in minutes and the ordinate taken for amount of toner filming H, and, in the graph, the solid line curve indicates the case of the blade having the thickness of 0.05 mm; whereas, the dotted line curve indicates the case of the blade having the thickness of 0.9 mm. As is obvious from the graph, with maintaining the remaining conditions in tact, a difference in thickness and thus rigidity alone can bring about a significant difference in the rate of formation of toner filming. Accordingly, the frequency for inspecting the formation of toner filming radically differs.

According to the various experiments conducted by the present inventors for studying the thin film forming characteristics of the doctor blade 27 and the toner sticking avoiding performance by changing various parameters such as the material and the size including thickness and length in the magnetic flux density ranging between 500 and 1,200 Gauss, it has been found that the desired thin film forming and toner sticking avoiding characteristics may be obtained by designing the blade 27 to satisfy the above relation (1) among Young's modulus E representing the mechanical property of the material forming the blade 27, and thickness d and length l representing the size of the blade 27. In other words, if the value of $Ed^3/l^3$ is smaller than 2,500, uniformity in contact pressure between the sleeve 21 and the blade 27 cannon be attained, so that the thin film of toner particles is not uniform especially in the direction in parallel with the rotating axis of the sleeve 21, indicating lacking of practical applicability. On the other hand, if the value of $Ed^3/l^3$ exceeds 250,000, sticking of toner particles to the sleeve 21 and to the blade 27 become appreciable, so that the amount of toner particles transported is lowered thereby causing a reduction in the level of charging the toner particles by friction and at the same time the formation of streaks in the resulting thin film of toner particles. For this reason, a thin film of toner particles can no longer be formed on the sleeve 21 consistently.

Figure 29:
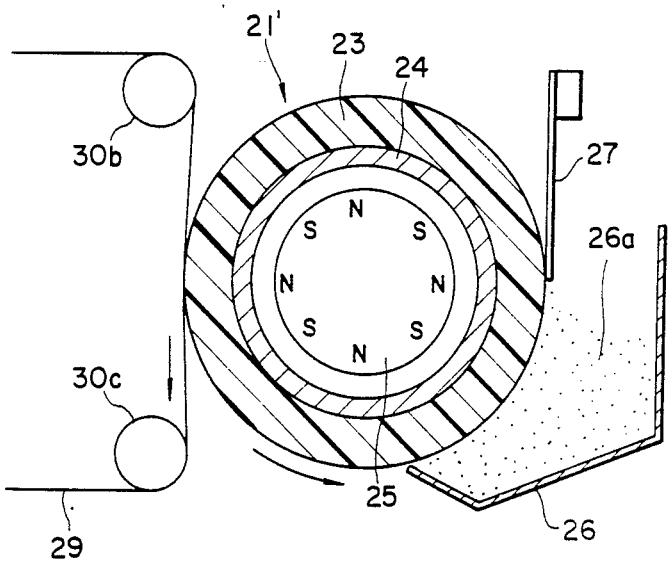
FIG. 29 is a schematic illustration showing a still another embodiment of the present developing device.

FIG. 29 shows a modification of the developing device shown in FIG. 27, and the difference between the two embodiments exist in the usage of the photosensitive belt 29 and the absence of floating electrodes in the embodiment of FIG. 29. In FIG. 29, the composite sleeve 21′ includes the outer dielectric sleeve 23 formed by a dielectric material as mentioned previously to the thickness of approximately 500 microns without provision of floating electrodes as different from the previous embodiment. In this embodiment, the magnetic flux density at the peripheral surface of the composite sleeve 21′ is set approximately at 750 Gauss, and the surface roughness of the sleeve 21′ is set in the order of the size, e.g., average diameter, of the toner particles used. The doctor blade 27 is formed to satisfy the above relation (1). With this structure, the desired thin film of uniformly changed toner particles may be formed on the sleeve 21′ consistently for an extended period of time without causing the problems of toner sticking and streaking.

Figure 30:
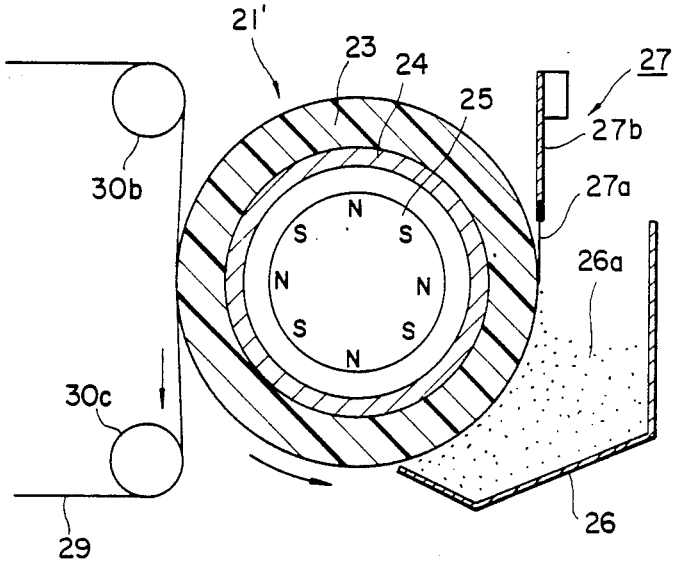
FIG. 30 is a schematic illustration showing a still another embodiment of the present developing device which has a two-part blade.

FIG. 30 shows a still further embodiment of the developing device for developing an electrostatic latent image by a thin film of toner particles constructed in accordance with the present invention. Structurally, the developing device shown in FIG. 30 is similar to any one of the above-described embodiments of the present invention, and, as shown, it includes a composite sleeve 21' which is rotatably supported in proximity to the image bearing member 29 such as a photosensitive member for bearing thereon an electrostatic latent image to be developed as formed by any of the well known image forming methods. The composite sleeve 21' is comprised of the inner conductive sleeve 24 and the outer dielectric sleeve 23 formed on the inner sleeve 24 and driven to rotate counterclockwise. Inside of the composite sleeve 21' is disposed the magnet roll 25 which may be provided to be rotatable or stationary. The developing device of FIG. 30 is characterized in the particular structure of the doctor blade 27. Stated more in detail, the blade 27 of the embodiment of FIG. 30 is a two-part blade and it includes a movable blade section 27*a* and a blade support section 27*b* for supporting the blade section 27*a* movably with respect thereto. Such a structure is advantageous because the contact pressure at the contact line between the blade 27 and the sleeve 21' may be kept uniform along the entire contact line thereby allowing to obtain a thin film of toner particles uniform in properties such as thickness and charges, and, moreover, the mounting accuracy of the sleeve 21 and/or the blade 27 may be minimized.

Figure 31:
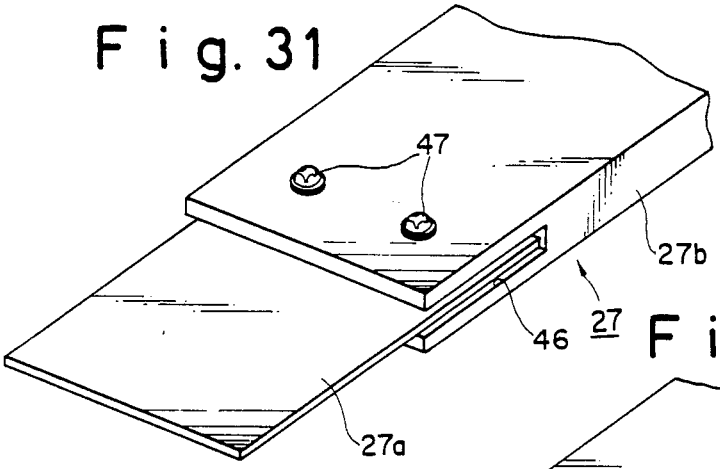
FIGS. 31–33 are several embodiments of the two-part blade to be used in the present developing device.

One example of such a two-part blade 27 is shown in FIG. 31. As shown, the two-part blade 27 includes the blade support section 27*b* whose free end is engraved to define a recess 46 which is slightly larger than the thickness of the blade section 27*a*. The movable blade section 27*b* is loosely fitted into the recess 46 and it is loosely held by a pair of screws 47, 47. That is, although not shown specifically, it should be understood that a pair of holes slightly larger than the screws 47 are provided in the blade section 27a, through which the screws 47, 47 extend loosely. Thus, the blade section 27*a* is freely movable with respect to the blade support section 27*b*, so that even if the support section 27*b* is fixedly mounted on the housing (not shown) or the blade section 27*a* and/or the support section 27*b* lacks enough elasticity, the freely movable blade section 27*a* may be brought into pressure contact with the sleeve 21' in a desired manner. For example, when the movable blade section 27*a* is formed by a magnetic material as set forth above, the blade section 27*a* will be attracted against the sleeve 21' even if the support section 27*b* stays straight. In other words, the support section 27*b* may be formed by any other material than a magnetic material, if desired. As may be understood, such a two-part blade is particularly useful in forming an extremely uniform thin film of toner particles.

Figure 32:
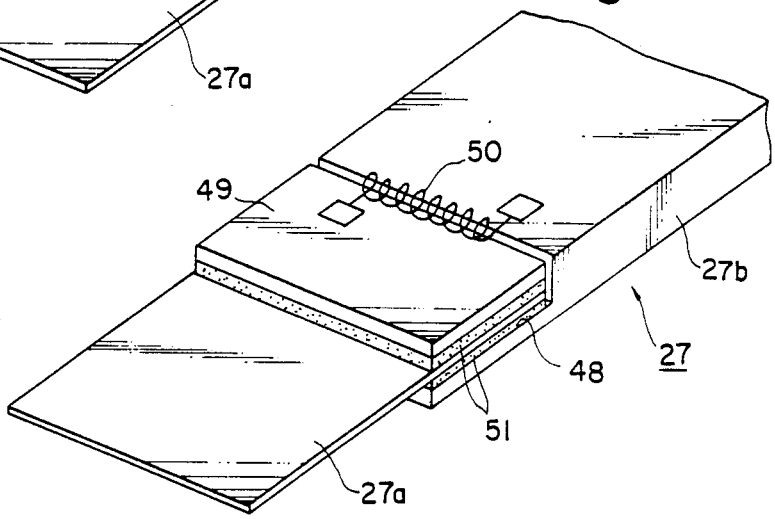

FIG. 32 shows another example of the two-part blade 27. In this example, the free end of the blade support section 27*b* is cut away on one side to define a stepped section 48. A pair of elastic members 51 made of an elastic material such as sponge and urethane are attached on both sides of the movable blade section 27*a* at its one end portion, and a holding plate 49 is attached to the top elastic member. A coil spring 50 is provided with its one end fixed to the holding plate 49 and the other end fixed to the blade support section 27*b*. The coil spring 50 causes the movable blade section 27*a* to be resiliently pressed against the stepped section 48 projecting from the support section 27*b*. As a result, the blade section 27*a* is shiftable with respect to the support section 27*b* through the elastic members 51 and also the coil spring 50. This structure also allows to bring the blade section 27*a* in contact with the sleeve 21' uniformly all along its contact line.

Figure 33:
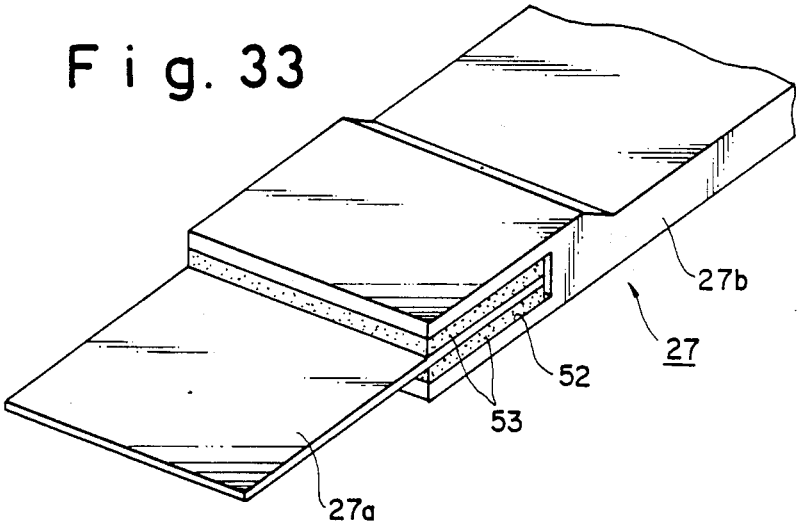

FIG. 33 shows a further example of the two-part blade 27. As shown, the blade support section 27*b* of this structure has a thicker end portion which is provided with a recess 52 into which the movable blade section 27*a* is inserted as sandwiched between a pair of elastic members 53, 53 on both sides. Also in this example, the blade section 27*a* is movable with respect to the support section 27*b* through the elastic members 53, 53, and, thus, the blade section 27*a* may be brought into pressure contact uniformly with the sleeve 21' as desired.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A developing device for developing an electrostatic latent image formed on an image bearing member using magnetic toner particles, comprising:

toner carrier means for carrying said magnetic toner particles along a predetermined path, a part of which defines a developing section where said electrostatic latent image is developed by said magnetic toner particles, said toner carrier means including an electrically conductive layer, a dielectric layer formed on said conductive layer and a plurality of floating electrodes provided in said dielectric layer and spaced apart from one another;

supply means for supplying said magnetic toner particles to said toner carrier means;

means for generating a magnetic field to be applied to said toner carrier means for causing said magnetic toner particles to be attracted to said toner carrier means while transported along said predetermined path;

pressure means disposed between said supplying means and said developing section in pressure contact with said toner carrier means for forming a thin film of magnetic toner particles which are charged to a predetermined polarity; and discharging means disposed in the downstream of said developing section for removing the charge from said toner carrier means.

2. The device of claim 1 wherein said pressure means is directed in a direction counter to the movement of said magnetic toner particles at the contact between said pressure means and said toner carrier means.

3. The device of claim 2 wherein said toner carrier means is formed in the shape of a sleeve which is driven to rotate in a predetermined direction so that said predetermined path is defined by the peripheral surface of said sleeve.

4. The device of claim 3 wherein said discharging means includes an electrically conductive brush disposed in contact with or spaced apart over a small distance from the peripheral surface of said sleeve.

5. The device of claim 4 further comprising means for applying a predetermined potential connected to said conductive layer, said brush and said pressure means thereby maintaining said conductive layer, said brush and said pressure means substantially at said predetermined potential.

6. The device of claimed 1 further comprising moving means for moving said pressure means in a direction perpendicular to the relative moving direction between said toner carrier means and said pressure means while maintaining said pressure means in pressure contact with said toner carrier means.

7. The device of claim 1 wherein said pressure means has Young's modulus E in $N \cdot m^{-2}$, thickness d in meter and length l in meter from its supporting point to the contact point between said pressure means and said toner carrier means, and these parameters satisfy the condition of $Ed^3/l^3$ being equal to or larger than 2,500 but equal to or smaller than 250,000.

* * * * *